United States Patent [19]

Kaes

[11] Patent Number: 5,002,078

[45] Date of Patent: Mar. 26, 1991

[54] METHOD OF AND CLEANING AGENT FOR THE CLEANING OF COMPRESSORS, ESPECIALLY GAS TURBINES

[75] Inventor: Gertrude Kaes, Vienna, Austria

[73] Assignee: Lang and Co., Chemisch-Technische Produkte Kommanditgesellschaft, Mauerbach/Wien, Austria

[21] Appl. No.: 564,173

[22] Filed: Aug. 7, 1990

[30] Foreign Application Priority Data

Aug. 11, 1989 [AT] Austria ..... 1928/89

[51] Int. Cl.[5] ..... B08B 3/14; B08B 7/00; B08B 5/00; C23G 23/00

[52] U.S. Cl. ..... 134/42; 134/2; 134/3; 134/19; 134/20; 134/31; 134/32; 134/33; 252/89.1; 252/173; 252/174.19; 252/DIG. 1; 252/DIG. 2

[58] Field of Search ..... 252/153, 86, 170, 173, 252/174.21, 547, 546, 548, 540, DIG. 14, DIG. 8, 50, DIG. 1, DIG. 2; 134/7, 20, 22.19, 3, 23, 33, 42; 106/5

[56] References Cited

U.S. PATENT DOCUMENTS

| | | | |
|---|---|---|---|
| 2,509,197 | 5/1950 | Borus | 252/DIG. 8 |
| 2,935,479 | 5/1960 | Oberdorfer | 252/170 |
| 3,074,822 | 1/1963 | Walk | 134/7 |
| 3,382,181 | 5/1968 | Oberdorfer | 252/170 |
| 3,400,017 | 9/1968 | Huebner | 134/7 |
| 3,491,027 | 1/1970 | Baker | 252/86 |
| 3,655,624 | 4/1972 | Chao | 252/50 |
| 3,779,213 | 12/1973 | Knudsen | 134/20 |
| 3,796,602 | 4/1974 | Briney | 134/38 |
| 3,830,660 | 8/1974 | Ezell | 134/23 |
| 3,879,216 | 4/1975 | Austin | 252/546 |
| 3,882,032 | 5/1975 | Bird | 252/50 |
| 3,882,038 | 5/1975 | Clayton | 252/547 |
| 4,014,786 | 4/1977 | Potter | 252/188.1 |
| 4,058,489 | 11/1977 | Hellsten | 252/540 |
| 4,065,322 | 12/1977 | Langford | 134/7 |
| 4,222,886 | 9/1980 | Connelly | 252/87 |
| 4,518,519 | 5/1985 | Lott | 252/87 |
| 4,540,505 | 9/1985 | Frazier | 252/547 |
| 4,713,120 | 12/1987 | Hodgens | 134/3 |
| 4,721,580 | 1/1988 | Gosselink | 252/173 |
| 4,801,331 | 1/1989 | Murase | 106/5 |
| 4,808,235 | 2/1989 | Woodson | 252/548 |
| 4,834,912 | 4/1989 | Hodgens | 252/548 |

FOREIGN PATENT DOCUMENTS

| | | |
|---|---|---|
| 1815955 | 8/1969 | Fed. Rep. of Germany . |
| 1714776 | 7/1973 | U.S.S.R. . |

*Primary Examiner*—A. Lionel Clingman
*Assistant Examiner*—Kevin McCarthy
*Attorney, Agent, or Firm*—Herbert Dubno

[57] ABSTRACT

The compressors of gas turbines are cleaned on-line or off-line by scrubbing them with an aqueous solution of dimethyl esters of succinic acid, glutaric acid and adipic acid together with nonionic and/or cationic surface active agents. The scrubbing solution components are easily biodegradable or break down during the operation of the turbine without forming corrosives or environmentally harmful components.

9 Claims, No Drawings

METHOD OF AND CLEANING AGENT FOR THE CLEANING OF COMPRESSORS, ESPECIALLY GAS TURBINES

FIELD OF THE INVENTION

The present invention, relates to a cleaning agent for compressors, especially those of gas turbines and to a method of cleaning them.

BACKGROUND OF THE INVENTION

Gas turbines are finding increasing numbers of applications and uses in modern technology and are expected in the next decade to become the most economical and flexible method of energy production from carbon and hydrogen containing fuels.

Gas turbines have been found to be particularly advantageous in the developing energy system referred to as cogeneration and which involves the joint generation of electric current and steam, where such gas turbines have significant advantages.

Gas turbines for use in energy generating applications and in many other cases may consist of a compressor and a turbine which have a common shaft or are so interconnected that the apparatus can operate in accordance with the Joule cycle, i.e. at constant pressure. Air is compressed in the compressor and is fed to a combustion chamber in which the temperature of the gases is increased while the pressure remains constant. The hot gases then drive the turbine.

It is known that the compressors of such gas turbines become soiled and coated with deposits which reduce the operating efficiency. Accordingly, such compressors must be cleaned continuously or repeatedly whether during a standstill of the gas turbine or, more advantageously, during its operation, i.e. by a so-called "on-line" cleaning system. This latter type of cleaning is usually accomplished apart from the traditional scrubbing of such turbines while they are out of operation, at reduced rotational speeds. The advantage of the on-line cleaning is that the compressor efficiency can be maintained or improved without the need to bring the apparatus to standstill and without cooling down of the apparatus. Since downtime can be avoided, the overall output of the apparatus can be improved.

Basically such on-line cleaning should be carried out frequently especially at certain time intervals. A complete replacement of the conventional off-line scrubbing or conventional dry cleaning of the turbine during an interruption in operation, is not the prime intention. However, the on-line cleaning allows fewer off-line cleaning cycles to be used and hence fewer interruptions in the operation of the apparatus in which also dry cleaning agents, such as ground nut shells, hard rice, synthetic resin particles or the like are employed and may, because of their abrasive characteristics, give rise to deterioration of the compressor blades and their coatings.

Up to now, on-line scrubbing mainly uses demineralized water, for example condensate water, having a total content of solids to a maximum of 5 ppm and containing the metals (Na+K+Pb+V) to a maximum of 0.5 ppm.

With respect to the on-line cleaning it is to be noted that the deposits which may arise on the compressor blades can accumulate in the hot regions in the turbine and can there have detrimental effects. It is necessary, as a consequence, depending upon the fields of application, operating conditions and the like to carefully monitor such on-line scrubbing operations.

With on-line as well as traditional off-line scrubbing it is important to achieve the highest possible degree of removal of all deposits and cleaning of the blades. The more complete the removal of such contaminants the better will be the operating efficiency of the apparatus and the less the frequency with which abrasive dry cleaning must be carried out to the point that such abrasive cleaning can be rendered totally superfluous.

OBJECTS OF THE INVENTION

It is the principal object of the present invention to provide a cleaning solution which is capable of removing deposits and soiling contaminants from the compressor of a gas turbine, usually consisting of dirt, sand, salts, carbon dust, insect traces, oils, polymers, turbine flue gas residues, in an efficient manner.

Another object of the invention is to provide a cleaning solution for the purposes described which can be used for both on-line and off-line cleaning compressors especially those of gas turbines, with equal effect.

Still another object of this invention is to provide a cleaning solution which itself is combustible without the formation of detrimental by-products or combustion products and which, if included in waste water, is readily biodegradable so that it does not pose an environmental problem.

Still another object of the invention is to provide an improved method of cleaning the compressors of gas turbines especially those used for cogeneration or in other energy producing applications.

DESCRIPTION OF THE INVENTION

These objects and others which will become apparent hereinafter are obtained by providing a compressor scrubbing solution, especially for the compressors of gas turbines, which comprise nonionic and/or cationic wash active substances together with at least one dimethyl ester of a dicarboxylic acid, especially succinic acid, glutaric acid and adipic acid.

According to a feature of the invention, the dimethyl ester component consisting of one or more of such dimethyl esters is present in the solution in an amount of 0.25 to 20% by weight while the wash active substance is present in an amount of 0.05 to 20% by weight of the cleaning solution which can contain demineralized water and which is fed to the compressor as a scrubbing liquid.

The cleaning solution can be prepared by mixing a concentrate with the demineralized water. In that case 1 to 20% by weight of the concentrate can be mixed with 99 to 80% by weight of demineralized water. The concentrate may itself consist of 50 to 94% by weight of the dimethyl dicarboxylic acid ester component and 5 to 50 parts by weight of nonionic and/or cationic wash active substances with an average HLB value of 3 to 20.

The demineralized water which can be used should have a maximum of 5 ppm dissolved solids and a maximum of 0.5 ppm total of the metals (Na+K+Pb+V) the pH of the demineralized water should be 6.5 to 7.5.

This composition has been found to be particularly effective for the cleaning of compressors while they remain in operation.

For scrubbing after standstill of the turbine, use may be made of water with a maximum of 100 ppm of dissolved solids and a maximum of 25 ppm Na+K and a pH of 6 to 8. The wash active substances are preferably biodegradable surface active agents (tensides.) The cleaning composition should be free from metal corroding ions, especially halogenide, sulfur and phosphorus compounds.

Most advantageously, the dimethyl ester component is a mixture of dimethyl glutarate, dimethyl succinate and dimethyl adipate.

The wash active substance is preferably selected from the group which consists of ethoxylated, propoxylated or aminoxylated alkyl, aralkyl, fatty alcohol, fatty acid or alkyl phenol hydrophobic moieties. In the cleaning step on-line, of course, the cleaning solution is fed to the compressor while the latter is in operation.

Dicarboxylic acids, especially a mixture of succinic acid, glutaric acid and adipic acid is obtained as a by-product in the production of adipic acid. They can be esterified with methanol to yield solvents which are very effective in dissolving polymers, have distillation ranges of 190° C. to 230° C. and consist only of the elements carbon, hydrogen and oxygen.

Because of the boiling point range, these solvents can be used even for the back surface cleaning of compressor blades in an on-line process without leaving oily residues. The boiling point 100° C. of water at standard pressure alone would not permit, the high compressor temperatures a fully satisfactory cleaning temperature especially on the back parts of such apparatus. The aqueous solutions of the invention thus have a much higher boiling range.

EXAMPLE 1

Off-line cleaning concentrate for compressors of all types is composed of 85 parts by weight dimethyl ester of a mixture of succinic acid, glutaric and adipic acids, 10 parts by weight of lauric amine ethoxylated with 10 moles of ethylene oxide and 5 parts by weight of $C_{13}$ alcohol ethoxylated with 9 moles of ethylene oxide.

The ester mixture comprised 17 parts by weight dimethyl adipate, 66 parts by weight dimethyl glutarate, 16.5 parts by weight dimethyl succinate, the balance water, methanol and organic by-products to 100 parts by weight. This ester mixture had the following properties Boiling point range: 196°-225° C.
Gel point (melting point): −20° C.
Flame point (closed crucible): 100° C.
Self-ignition temperature: 370° C.
Viscosity at 25° C.: 2.4 mPas
Surface tension at 20° C.: 35.6 mN/m
Specific gravity 20/20° C.: 1.092 $kg.dm^{-3}$ A 5% aqueous solution of this cleaning concentrate was formed and in accordance with the prescribed procedure of General Electric is used to scrub a gas turbine compressor in an off-line (unfired operation). The water for this off-line cleaning contained less than 100 ppm soluble solids and less than 25 ppm Na +K and a pH of 6 to 8.

The compressor, which suffered a loss of output because of soiling of 1.7% before the cleaning, recovered full output with cleaning with this 5% solution consisting of the dimethyl ester mixture and described wash active substances (WAS), followed by rinsing with demineralized water.

EXAMPLE 2

The cleaning concentrate of Example 1 was used for an on-line cleaning method also in a 5% aqueous solution. The 95% by weight water contained a maximum of 5% soluble solids and less than 0.5 ppm of the sum of the metals (Na+K+Pb+V) as well as a pH value of 6.5 to 7.5. With a gas turbine MS 6.000 with an output of 100 megawatts, utilizing 14 nozzles, 2.65 liters per minute of the solution and a pressure of 100 psig was sprayed into the compressor for 30 minutes, on-line, i.e. during the operation of the gas turbine. Thereafter using the same spray system and water of the same quality as used in the cleaning solution was flushed through the turbine also without shutting down the system. The scrubbing was carried out after the gas turbine had been in operation for 40 days and the compressor, by contamination, lost 1.5% of its efficiency and after 70 to 80 days manifested a loss of 1.8 to 2% of its efficiency. A single on-line cleaning as described was able to halve the efficiency drop.

EXAMPLE 3

Off-line and on-line cleaning was carried out with cleaning solutions as described in Example 1 and Example 2 except that the concentrate contained a dimethyl ester mixture with different properties, namely, the following: 62 parts by weight dimethyl glutarate, 23 parts by weight dimethyl succinate, 15 parts by weight dimethyl adipate.

Boiling point range: 200°-230° C.
Flame point (open crucible): 108° C.
Self-ignition temperature: 360° C.
Viscosity at 20° C.: 3 mPas
Surface tension at 20° C.: 35.6 mN/m
Specific gravity 20/20° C.: 1.090 $kg.dm^{-3}$ The respective 5% cleaning solutions, containing the same WAS gave analogous results. With on-line cleaning and continuous operation, the continuous operation time after each cleaning was increased by 2 to 4 times.

EXAMPLE 4

To a 6.5 MW gas turbine 40,000 $m^3/h$ of air containing organic contaminants was fed, bypassing expensive air cleaning procedures.

To clean the compressor from the relatively high level of organic polymer contaminants, a 7% wash active solution according to the invention in demineralized water was employed in an off-line and on-line procedure.

The wash active solution consisted of 15 parts by weight stearile amine ethoxylated with 12 moles of ethylene oxide, 6 parts by weight of a maleic acid copolymer with a molecular weight of 2000, 7 parts by weight of a fatty alcohol polypropylene oxide ethoxy product with 10 moles of ethylene oxide, 16 parts by weight of a dimethyl esters mixture and parts by weight of demineralized water. The dimethyl esters mixture consisted of dimethyl adipate, dimethyl glutarate and dimethyl succinate. The mixture had the following characteristics:

Average molecular weight: about 160
Specific gravity at 20° C.: 1.090 $g.cm^{-3}$
Refractive index: 1.423
Distillation range: 200° to 230+ C.
Vapor pressure at 20° C.: 0.08 mbar
Dynamic viscosity at 20° C.: 3 mPa.s
Evaporation at 80° C.: 0.031/ $g.mn^{-1}$
Flame point: 108° C.
Self-ignition point: 360° C.
Acid number (in mg KOH/g): less than 0.3
Atomic analysis: C, H, O The cleaning solutions were successful for both the on-line and off-line cleaning as described and were found to be especially effective for the removal of organic polymer impurities by dissolving them to maintain the efficiency of compressor.

EXAMPLE 5

The cleaning concentrate consisted of 18 parts by weight of cationic fatty amine ethoxylated, 11 parts by weight of nonionic fatty alcohol ethoxylate, 6 parts by weight dimethyl ester mixture of Example 4 and 65 parts by weight of demineralized water. (Whenever a fatty acid or fatty amine or fatty alcohol is mentioned herein without further particularization, the economical $C_{12}$–$C_{18}$ compound may be understood.)

This cleaning concentrate is mixed with condensate water to form a 5 to 20% solution for on-line and off-line cleaning of compressors. The impurities in the solution lie far below the limits permitted by the turbine manufacturers and amount to:

Chlorine: 0.50 to 2.00 ppm
Sodium and potassium: 4.60 to 18.40 ppm
Lead: 0.06 to 0.22 ppm
Vanadium: 0.03 to 0.10 ppm
Phosphorous: 0.19 to 0.76 ppm
Iron: 0.03 to 0.10 ppm
Tin: 0.03 to 0.10 ppm
Silicon: 0.05 to 0.20 ppm
Aluminum: 0.03 to 0.10 ppm
Copper: 0.03 to 0.10 ppm
Manganese: 0.01 to 0.02 ppm
Calcium: 0.18 to 0.70 ppm
pH: 7 to 7.2 ppm Compressor cleaning is effected with this solution with high efficiency and without corrosive attack on the compressor.

EXAMPLE 6

The WAS used in combination with the described dimethyl ester mixture was varied in the following tests.

(a) 5 to 50 % by weight nonionic WAS alone, balance dimethyl ester mixture
(b) 5 to 50% weight percent cationic WAS alone, balance dimethyl ester mixture
(c) 2.5 to 25% by weight nonionic and 2.5 to 25% by weight cationic WAS, balance dimethyl ester mixture.

The composition of the nonionic and cationic compounds were those described above and could be ethoxylated, propoxylated, aminoxidized products with alkyl, aralkyl, fatty alcohol, fatty acids, alkyl phenol or other hydrophobic moieties. The HLB value (hydrophyl-lipophyl balance) of the WAS or its mixtures could be an average between 3 and 20. Best results were obtained with a mixture in accordance with (c) above.

Important for the on-line cleaning is the practically total absence of metal components and corrosive ions, for example those of halogenide, sulfur and phosphorous compounds.

Even for off-line scrubbing the content of these compounds should be limited below 25 ppm.

The concentrate should be used in an amount of 1 to 20 percent by weight of the cleaning solution. The aforedescribed dimethyl ester mixtures have a water solubility of 5% in the absence of surfactants (tensides). In the presence of nonionic and cationic surfactants, the solubility of the dimethyl ester mixture is greatly increased.

Naturally, higher proportions of the cleaning concentrate in the water will improve the cleaning of the more soiled compressors with oily, fatty, sooty and polymer containing contaminants.

The cleaning has been found to be most effective for compressors of gas turbines driven with natural gas, mineral oil products, coal and similar carbon and hydrocarbon containing fuels. The mixture of dimethyl dicarboxylic acid esters with nonionic and/or cationic surface active agents is, however, also suitable for compressors of all types especially when these may operate in flue gas contaminated, sooty or oily environments or with air containing soot and oil.

In the cleaning of compressors which are not in operation, i.e. are off-line, the biological degradation properties of the dimethyl ester in the waste water proves to be very important. Of course it is advantageous in this case also to use biodegradable surfactants. For the on-line cleaning it is advantageous that the compressed air carrying the residue of the cleaning agent is subjected to a combustion process since the cleaning solution is readily decomposed without the formation of environmental contaminants.

I claim:

1. A method of cleaning a compressor of a gas turbine comprising the steps of scrubbing said gas turbine with a cleaning solution consisting essentially 0.05 to 20% by weight of a surface active component selected from the group consisting of nonionic and cationic wash active substances, 0.25 to 20% by weight of a dimethyl ester component consisting of at least one dimethyl ester of a dicarboxylic acid, and demineralized water; and rinsing said compressor with demineralized water.

2. The method defined in claim 1 wherein said surface active component is present in an amount of 0.05 to 20% by weight of the solution, said dimethyl ester component is present in an amount of 0.25 to 20% by weight and the balance of said solution is demineralized water.

3. The method defined in claim 2 wherein said components are combined with the said water in the form of a concentrate and in an amount of 1 to 20% by weight of said concentrate, said concentrate consisting of 50 to 94 parts by weight of said dimethyl ester component and 5 to 50 parts by weight of said surface active component, said surface active component having an average HLB value of 3 to 20.

4. The method defined in claim 2 for the cleaning of a compressor during operation thereof when said water contains a maximum of 5 ppm soluble solids and a maximum of 0.5 ppm of the metals Na+K+Pb and V in total, said water having a pH of 6.5 to 7.5.

5. The method defined in claim 2 for cleaning a turbine during standstill thereof wherein said water has a pH of 6 to 8 and contains a maximum of 100 ppm soluble solids and a maximum of 25 ppm Na+K.

6. The method defined in claim 2 wherein said surface active component is composed of biodegradable substances.

7. The method defined in claim 2 wherein said solution is free from metal corroding ions and halogenide, sulfur and phosphorous compounds.

8. The method defined in claim 2 wherein the dimethyl ester component consists of a mixture of dimethyl glutarate, dimethyl succinate and dimethyl adipate.

9. The method defined in claim 2 wherein the surface active component is selected from the group which consists of ethoxylated, propoxylated or aminoxidated, alkyl, aralkyl, fatty alcohol, fatty acid and alkylphenol moieties.

* * * * *